US010842228B2

(12) United States Patent
Kuo et al.

(10) Patent No.: US 10,842,228 B2
(45) Date of Patent: Nov. 24, 2020

(54) METHOD FOR MANUFACTURING SHOE EMBRYO TAILORED FROM TUBULAR FABRIC AND ASSOCIATED SHOE EMBRYO

(71) Applicant: Wholeknit International Co., Ltd., Apia (WS)

(72) Inventors: Ming-Sheng Kuo, Apia (WS); Yu-Lin Li, Apia (WS); Chien-Hui Yang, Apia (WS)

(73) Assignee: Wholeknit International Co., Ltd., Apia (WS)

( * ) Notice: Subject to any disclaimer, the term of this patent is extended or adjusted under 35 U.S.C. 154(b) by 285 days.

(21) Appl. No.: 15/358,922

(22) Filed: Nov. 22, 2016

(65) Prior Publication Data

US 2018/0140050 A1 May 24, 2018

(51) Int. Cl.

| | |
|---|---|
| ***A43B 23/04*** | (2006.01) |
| ***A43D 8/02*** | (2006.01) |
| ***A43B 23/07*** | (2006.01) |
| ***A43B 1/04*** | (2006.01) |

(52) U.S. Cl.

CPC ..... *A43B 23/042* (2013.01); *A43B 1/04* (2013.01); *A43B 23/07* (2013.01); *A43D 8/02* (2013.01)

(58) Field of Classification Search

CPC ..... A43B 23/042; A43B 23/07; A43B 1/04; A43D 8/02

USPC ..... 66/185

See application file for complete search history.

(56) References Cited

U.S. PATENT DOCUMENTS

| | | | | | |
|---|---|---|---|---|---|
| 2,001,293 | A | * | 5/1935 | Wilson | A43B 1/04 66/171 |
| 2,047,724 | A | * | 7/1936 | Zuckerman | D04B 1/24 66/177 |
| 2,076,285 | A | * | 4/1937 | Wiggin | A43B 3/14 36/11 |
| 2,440,393 | A | * | 4/1948 | Clark | A43B 1/02 12/142 G |
| 2,467,237 | A | * | 4/1949 | Sherman | A43B 1/04 12/114.6 |
| 2,641,004 | A | * | 6/1953 | Ronyan | A43B 1/02 12/133 R |
| 3,143,870 | A | * | 8/1964 | Smith | A41B 11/10 36/9 R |
| 3,694,940 | A | * | 10/1972 | Stohr | A43B 7/34 36/10 |

(Continued)

FOREIGN PATENT DOCUMENTS

TW M515792 U 1/2016

*Primary Examiner* — Katharine Gracz

(74) *Attorney, Agent, or Firm* — Muncy, Geissler, Olds & Lowe, P.C.

(57) ABSTRACT

A shoe embryo tailored from a tubular fabric is provided. The shoe embryo includes a sole portion, a toe cap portion located at one end of the sole portion, a heel portion located at the other end of the sole portion, and an ankle portion located above the sole portion and near the heel portion. The ankle portion includes an ankle opening overlock line formed by trimming the tubular fabric and overlocking. The heel portion includes a heel overlock line formed by trimming the tubular fabric and overlocking, and a sole overlock line formed by folding below the heel overlock line and overlocking. The toe cap portion includes a toe cap overlock line formed by trimming the tubular fabric and overlocking.

2 Claims, 15 Drawing Sheets

(56) References Cited

U.S. PATENT DOCUMENTS 3,985,003 A * 10/1976 Reed ..... D04B 9/42 66/196
4,150,498 A * 4/1979 Palmer ..... A43B 3/106 2/239
5,125,116 A * 6/1992 Gaither ..... A41B 11/00 2/239
5,345,638 A * 9/1994 Nishida ..... A41H 3/08 12/146 C
5,499,459 A * 3/1996 Tomaro ..... A43B 1/0045 36/10
5,659,914 A * 8/1997 Steinlauf ..... A43B 23/07 12/145
6,308,438 B1 * 10/2001 Throneburg ..... A43B 1/02 36/11
6,558,784 B1 * 5/2003 Norton ..... A43B 5/002 12/146 C
7,937,972 B2 * 5/2011 Busi ..... D04B 1/108 66/19
8,701,232 B1 * 4/2014 Droege ..... A43B 1/04 12/142 R
9,877,536 B2 * 1/2018 Huffman ..... A43B 1/04
2002/0012784 A1 * 1/2002 Norton ..... A43B 5/002 428/304.4
2007/0137069 A1 * 6/2007 Patakos ..... A43B 1/0027 36/113
2007/0227038 A1 * 10/2007 Edington ..... A43B 19/00 36/10
2008/0110048 A1 * 5/2008 Dua ..... A43B 1/04 36/45
2011/0056096 A1 * 3/2011 Raith ..... A43B 3/0057 36/25 R
2011/0225845 A1 * 9/2011 Dean ..... A43B 3/0078 36/83
2011/0289797 A1 * 12/2011 Madelaine ..... A43B 3/103 36/88
2012/0240429 A1 * 9/2012 Sokolowski ..... A43B 3/0031 36/50.1
2012/0255201 A1 * 10/2012 Little ..... A43B 1/04 36/84
2013/0104422 A1 * 5/2013 Hatfield ..... A43B 5/001 36/103
2013/0160323 A1 * 6/2013 Hsiao ..... A43B 3/248 36/45
2013/0269211 A1 * 10/2013 Deans ..... A41B 11/008 36/84
2013/0318822 A1 * 12/2013 Wang ..... A43B 23/24 36/83
2014/0082905 A1 * 3/2014 Wen ..... D03D 3/02 28/142
2014/0237854 A1 * 8/2014 Fallon ..... A43B 1/04 36/84
2014/0245632 A1 * 9/2014 Podhajny ..... A43B 1/04 36/45
2014/0245633 A1 * 9/2014 Podhajny ..... A43B 1/04 36/45
2014/0352173 A1 * 12/2014 Bell ..... A43B 1/04 12/142 G
2015/0075031 A1 * 3/2015 Podhajny ..... A43B 1/04 36/45
2015/0150335 A1 * 6/2015 Healy ..... A43B 7/12 36/87
2015/0289592 A1 * 10/2015 Song ..... A43B 1/0072 36/83
2015/0342284 A1 * 12/2015 Huffman ..... A43B 1/04 12/142 G
2015/0342285 A1 * 12/2015 Huffman ..... A43B 23/024 36/9 R
2015/0342286 A1 * 12/2015 Huffman ..... A43B 1/04 36/9 R
2017/0143059 A1 * 5/2017 Gallagher ..... A41D 27/245
2018/0133555 A1 * 5/2018 Ortwig ..... A43B 5/08
2018/0140050 A1 * 5/2018 Kuo ..... A43B 23/042
2018/0343955 A1 * 12/2018 Li ..... A43B 1/14
2018/0343956 A1 * 12/2018 Li ..... D04B 1/108

* cited by examiner

METHOD FOR MANUFACTURING SHOE EMBRYO TAILORED FROM TUBULAR FABRIC AND ASSOCIATED SHOE EMBRYO

FIELD OF THE INVENTION

The present invention relates to a method for manufacturing a shoe embryo and an associated shoe embryo, and particularly to a method for manufacturing a shoe embryo tailored from a tubular fabric and an associated shoe embryo.

BACKGROUND OF THE INVENTION

A shoe in general includes two parts—a shoe upper and a sole. The sole is secured below the shoe upper. A material of the shoe upper focuses on providing comfort and firmness. For example, there are diversified choices of materials having different properties for the shoe upper of sports shoes. The so-called "different properties" include tensile resistance, wear resistance, flexibility, air permeability, compressibility, moisture absorption and quick perspiration drying. More specifically, the shoe upper may be formed by materials including textiles, leather, synthetic leather or rubber. Common materials for making the commercial shoe upper include textiles, polymer foams, polymer sheets, leather and synthetic leather. However, one of the most common base materials for making the shoe upper or sports shoes or the shoe upper of casual shoes is fabrics manufactured from yarns of composite materials by a weaving machine. Once such fabric is formed three-dimensionally, a shoe embryo is formed. One main reason that the shoe embryo is extensively applied as the base material of sports shoes or casual shoes is that, the shoe embryo can be given different properties in different areas, including functional purposes of tensile resistance, wear resistance, flexibility, air permeability, compressibility, comfort, and moisture absorption. It is thus known from above, the shoe embryo is a semi-finished product before such shoes are completely manufactured. That is to say, the shoe embryo requires further subsequent processes, such as inserting a vamp model for shaping, surface ironing, gluing/heating/pressurizing, paint spraying and dye, sole gluing and extracting the vamp model. In current technologies for the shoe embryo, e.g., the Taiwan Patent No. M515792, a three-dimensional shoe embryo is generally formed by combining, splicing and sewing multiple different planar fabrics. However, the technical means for manufacturing the shoe embryo suffers from certain drawbacks that need to be overcome. First of all, to re-organize, splice and sew different planar fabrics to form a three-dimensional shoe embryo, an operating staff is required to have sophisticated techniques and capabilities, which can only be achieved through professional tailor training, hence inevitably leading to significant manpower costs for manufacturers. Secondly, when the planar fabrics are re-organized, spliced and sewn, deformation of the shoe embryo and splicing deviations may likely occur due to human factors such as alignment errors, in a way that the yield rate of the shoe embryo may not be effectively increased and material costs are substantially increased for manufacturers. Thirdly, processes for combining and splicing the planar fabrics are tedious, which limits both production efficiency and production throughput.

SUMMARY OF THE INVENTION

In view of the above drawbacks of known technologies, it is a primary object of the present invention to shorten work hours, boost production efficiency, increase product yield rate and reduce manpower costs to achieve enhanced industry competitiveness.

To achieve the above object, the present invention provides a method for manufacturing a shoe embryo tailored from a tubular fabric. The method includes: providing at least two yarns to weave and form a tubular fabric, weaving a toe portion tailor auxiliary line at one end of the tubular fabric and a heel portion tailor auxiliary line at the other end, and weaving an ankle portion tailor auxiliary line at a position between the heel portion tailor auxiliary line and the toe portion tailor auxiliary line and near the heel portion tailor auxiliary line, wherein the tubular fabric is sequentially defined into a toe portion trimmed region, an ankle portion trimmed region and a heel portion trimmed region by the toe portion tailor auxiliary line, the ankle portion tailor auxiliary line and the heel portion tailor auxiliary line, respectively; trimming and removing the ankle portion trimmed region, and performing an overlock process according to the ankle portion tailor auxiliary line to form an ankle opening overlock line at the tubular fabric; trimming and removing the heel portion trimmed region, and performing an overlock process according to the heel portion tailor auxiliary line to form a heel overlock line at the tubular fabric; folding below the heel overlock line to form a concave crease and a revealed crease, such that a sole trimmed region is defined at the tubular fabric by the concave crease and the revealed crease; trimming and removing the sole trimmed region, and performing an overlock process according to the concave crease to form a sole overlock line at the tubular fabric; trimming and removing the toe portion trimmed region, and combining the toe portion tailor auxiliary line in an overlapping manner for an overlock process to form a toe cap overlock line at the tubular fabric; and performing shaping to form a shoe embryo including an ankle portion, a heel portion, a toe cap portion and a sole portion.

Further, in the method for manufacturing a shoe embryo from tailoring a tubular fabric, the tubular fabric is woven from at least two differently-colored yarns.

Further, in the method for manufacturing a shoe embryo from tailoring a tubular fabric, the ankle portion tailor auxiliary line, the heel portion tailor auxiliary line and the toe portion tailor auxiliary line is selected and woven from at least one of the yarns used for weaving the tubular fabric.

Further, in the method for manufacturing a shoe embryo from tailoring a tubular fabric, the ankle portion tailor auxiliary line, the heel portion tailor auxiliary line and the toe portion tailor auxiliary line is selected and woven from at least one of the colors of the yarns used for weaving the tubular fabric.

Further, in the method for manufacturing a shoe embryo from tailoring a tubular fabric, the toe portion tailor auxiliary line includes an arched above-top auxiliary segment and an arched below-toe auxiliary segment connected to two ends of the above-toe auxiliary segment, and the length of the above-toe auxiliary segment is greater than the length of the below-toe auxiliary segment.

To achieve the above object, the present invention further provides a shoe embryo tailored and manufactured from a tubular fabric. The shoe embryo is tailored from a tubular fabric, and includes a sole portion, a toe cap portion located at one end of the sole portion, an ankle portion located at the other end of the sole portion, and a heel portion located above the sole portion and near the heel portion. The ankle portion includes an ankle opening overlock line formed by trimming the tubular fabric and overlocking. The heel portion includes a heel overlock line formed by trimming the tubular fabric and overlocking, and a sole overlock line formed by folding below the heel overlock line and overlocking. The toe cap portion includes a toe cap overlock line formed by trimming the tubular fabric and overlocking.

Further, in the shoe embryo tailored and manufactured from a tubular fabric, a joint of the ankle portion and the heel portion is extended to form a shoe upper.

To achieve the above object, the present invention further discloses a method for manufacturing a shoe embryo tailored from a tubular fabric. The method includes: providing at least two yarns to weave and form a tubular fabric, weaving a toe portion tailor auxiliary line at one end of the tubular fabric and weaving a lining sealing auxiliary line at the other end, weaving a heel portion tailor auxiliary line at a center between the toe portion tailor auxiliary line and the lining sealing auxiliary line to define a lining fabric between the heel portion tailor auxiliary line and the lining sealing tailor auxiliary line, and weaving an ankle portion tailor auxiliary line at a position between the heel portion tailor auxiliary line and the toe portion tailor auxiliary line and near the heel portion tailor auxiliary line, wherein the tubular fabric is sequentially defined into a toe portion trimmed region, an ankle portion trimmed region, a heel portion trimmed region and a lining trimmed region by the toe portion tailor auxiliary line, the ankle portion tailor auxiliary line, the heel portion tailor auxiliary line and the lining seal auxiliary line, respectively; trimming and removing the lining trimmed region, and combining the lining sealing auxiliary line in an overlapping manner for an overlock process to form a lining overlock line at the tubular fabric; folding the lining fabric in reverse into the tubular fabric using the heel portion tailor auxiliary line as a basis; together trimming and removing the ankle portion trimmed region and a part of the lining fabric corresponding to the ankle portion trimmed region, and performing an overlock process jointly with the lining fabric according to the ankle portion tailor auxiliary line to form an ankle opening overlock line at the tubular fabric; together trimming and removing the heel portion trimmed region and a part of the lining fabric corresponding to the heel portion trimmed region, and performing an overlock process jointly with the lining fabric according to the heel portion tailor auxiliary line to form a heel overlock line at the tubular fabric; folding below the heel overlock line to form a concave crease and a revealed crease, such that a sole trimmed region is defined at the tubular fabric by the concave crease and the revealed crease; trimming and removing the sole trimmed region, and performing an overlock process according to the concave crease to form a sole overlock line at the tubular fabric; trimming and removing the toe portion trimmed region, and combining the toe portion tailor auxiliary line in an overlapping manner for an overlock process to form a toe cap overlock line; and performing shaping to form a shoe embryo including an ankle portion, a heel portion, a toe cap portion and a sole portion as well as the lining fabric therein.

Further, in the method for manufacturing a shoe embryo from tailoring a tubular fabric, the tubular fabric is woven from at least two differently-colored yarns.

Further, in the method for manufacturing a shoe embryo from tailoring a tubular fabric, the lining sealing auxiliary line, the ankle portion tailor auxiliary line, the heel portion tailor auxiliary line and the toe portion tailor auxiliary line are selected and woven from at least one of the yarns used for weaving the tubular fabric.

Further, in the method for manufacturing a shoe embryo from tailoring a tubular fabric, the lining sealing auxiliary line, the ankle portion tailor auxiliary line, the heel portion tailor auxiliary line and the toe portion tailor auxiliary line are selected and woven from at least one of the colors of the yarns used for weaving the tubular fabric.

Further, in the method for manufacturing a shoe embryo from tailoring a tubular fabric, the toe portion tailor auxiliary line includes an arched above-top auxiliary segment and an arched below-toe auxiliary segment connected to two ends of the above-toe auxiliary segment, and the length of the above-toe auxiliary segment is greater than the length of the below-toe auxiliary segment. Further, the lining sealing auxiliary line includes an arched upper auxiliary segment and an arched lower auxiliary segment connected to two ends of the upper auxiliary segment.

Further, in the method for manufacturing a shoe embryo from tailoring a tubular fabric, the length of the upper auxiliary segment is greater than or equal to the length of the lower auxiliary segment.

To achieve the above object, the present invention further provides a shoe embryo manufactured and tailored from a tubular fabric. The shoe embryo is tailored from a tubular fabric, and is characterized that, the shoe embryo includes a lining fabric having a front end combined in an overlapping manner and overlocked therein, a sole portion, a toe cap portion located at one end of the sole portion, an ankle portion located at the other end of the sole portion, and a heel portion located above the sole portion and near the heel portion; the ankle portion includes an ankle opening overlock line formed by together trimming and overlocking the tubular fabric and the lining fabric; the heel portion includes a heel overlock line formed by together trimming and overlocking the tubular fabric and the lining fabric, and a sole overlock line formed by folding below the heel overlock line and overlocking. The toe cap portion includes a toe cap overlock line formed by trimming the tubular fabric and overlocking.

Further, in the shoe embryo tailored and manufactured from a tubular fabric, a joint of the ankle portion and the heel portion is extended to form a shoe upper.

With the technical solution above, the present invention achieves effects below as opposed to currently known technologies. First of all, as the tubular fabric of the present invention is directly sewn using a three-dimensional shape, and involves no re-organizing, splicing and sewing processes. In the process of trimming and overlocking the tubular fabric in the tubular three-dimensional shape, the issue of error and deviation are unlikely to occur, such that not only the yield rate of the shoe embryo can be promoted without causing a waste in material costs, but also such process of trimming and overlocking can be performed by operators without professional tailor training, thereby helping in reducing manpower costs. Secondly, in the present invention, auxiliary lines apparently visible are woven on the tubular fabric to assist a process operator to perform trimming and overlocking. Thus, an operator may promptly position and process according to exact positions of these auxiliary lines to further optimize production efficiency. Thirdly, with the shoe embryo that is manufactured from the tubular fabric in a tubular three-dimensional shape, re-organizing and splicing processes in currently known technologies can be eliminated. As the processes are simplified, the work hours required for production are also shortened, which further accounts for a factor for effectively enhancing production efficiency and industry competitiveness.

DETAILED DESCRIPTION OF THE PREFERRED EMBODIMENTS

Details of a method for manufacturing a shoe embryo tailored from a tubular fabric and a shoe embryo of the present invention are given in the non-limiting embodiments with the accompanying drawings below.

Figure 1:
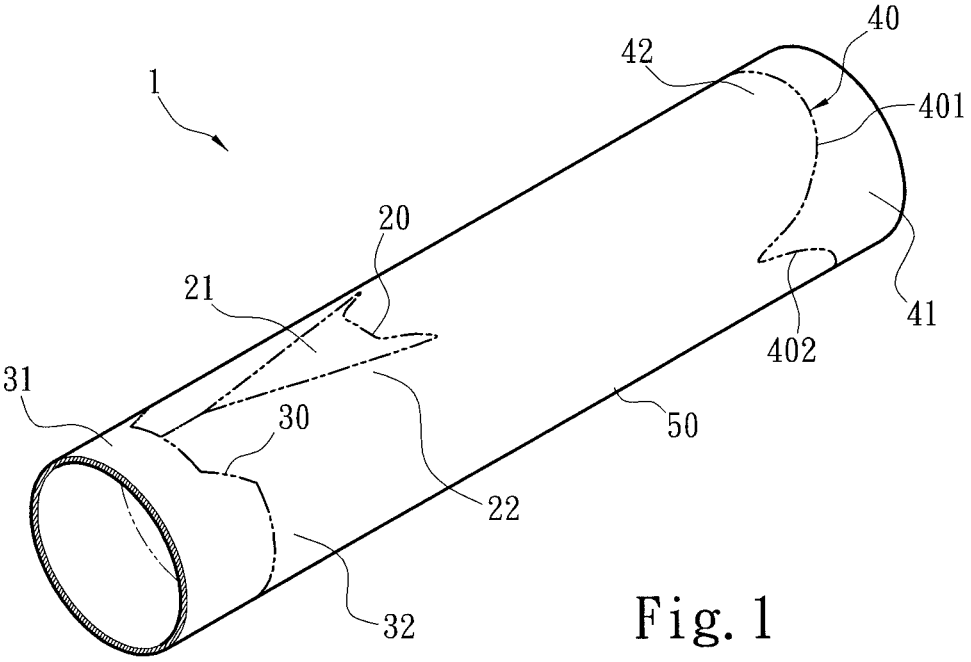
FIG. 1 is an isometric appearance schematic diagram of a tubular fabric according to a first embodiment of the present invention.
Figure 2:
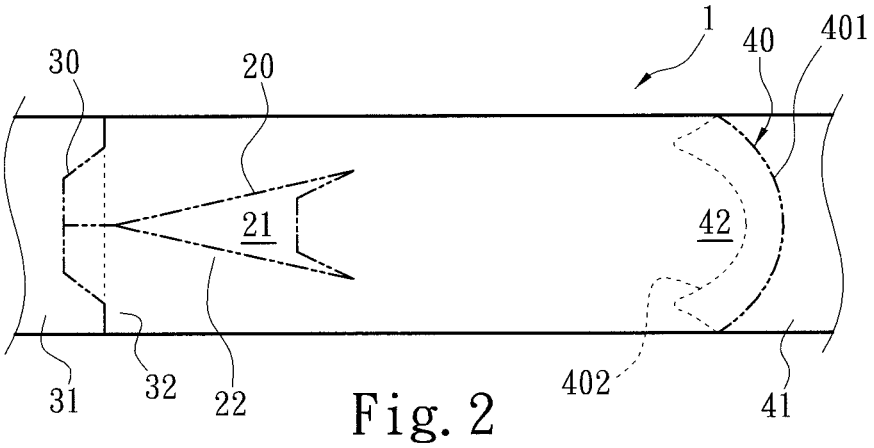
FIG. 2 is a top planar view of FIG. 1 of the present invention.
Figure 3:
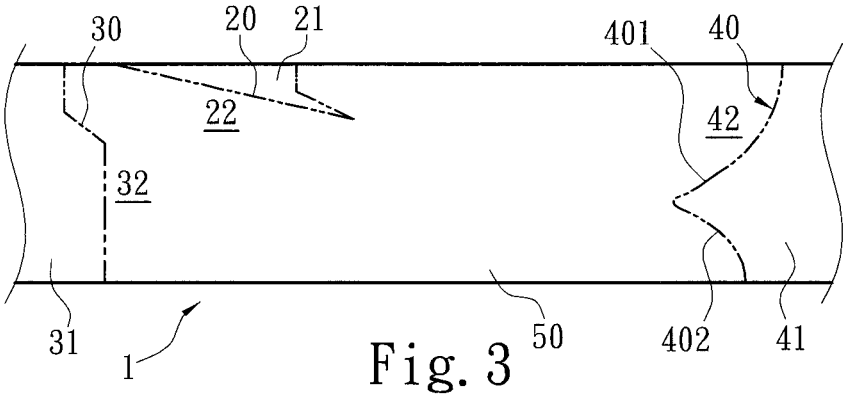
FIG. 3 is a side planar view of FIG. 1 of the present invention.
Figure 4:
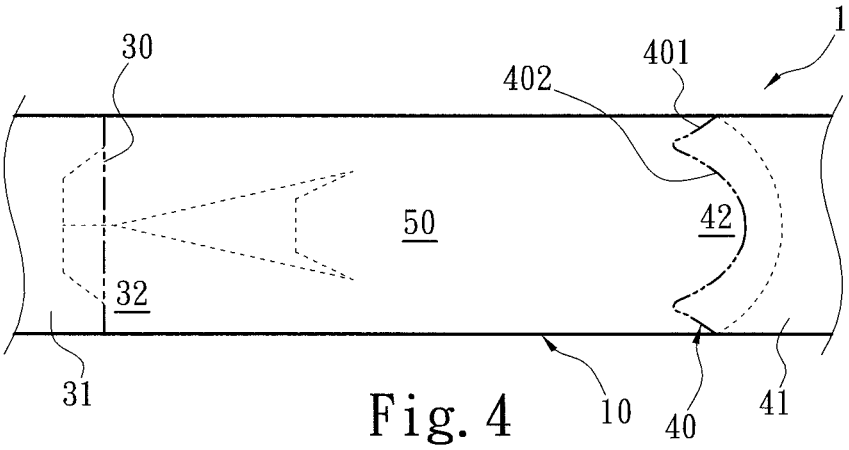
FIG. 4 is a bottom planar view of FIG. 1 of the present invention.
Figure 5:
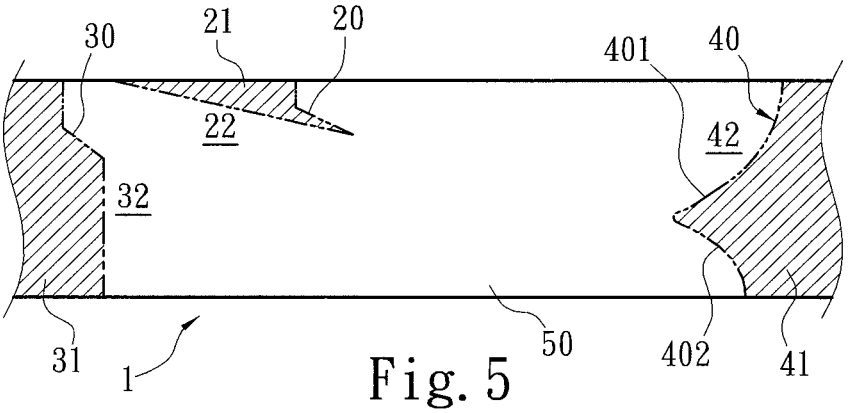
FIG. 5 is a schematic diagram of trimmed regions respectively represented by slanted lines in FIG. 3.
Figure 6:
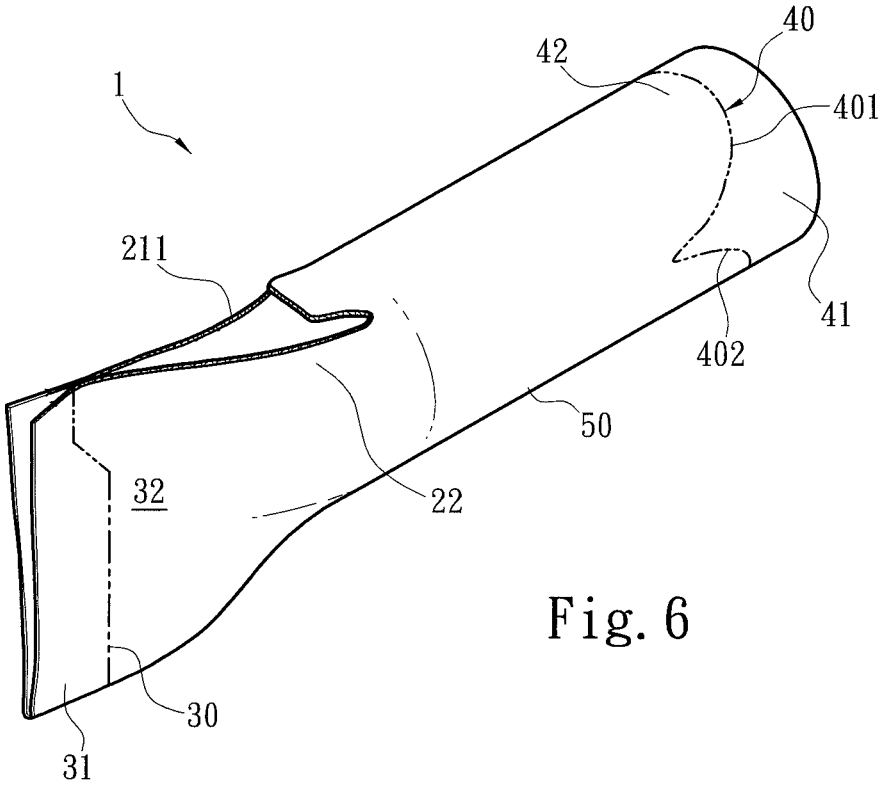
FIG. 6 is an isometric appearance schematic diagram of the tubular fabric in FIG. 1 of the present invention having been trimmed and overlocked.
Figure 7:
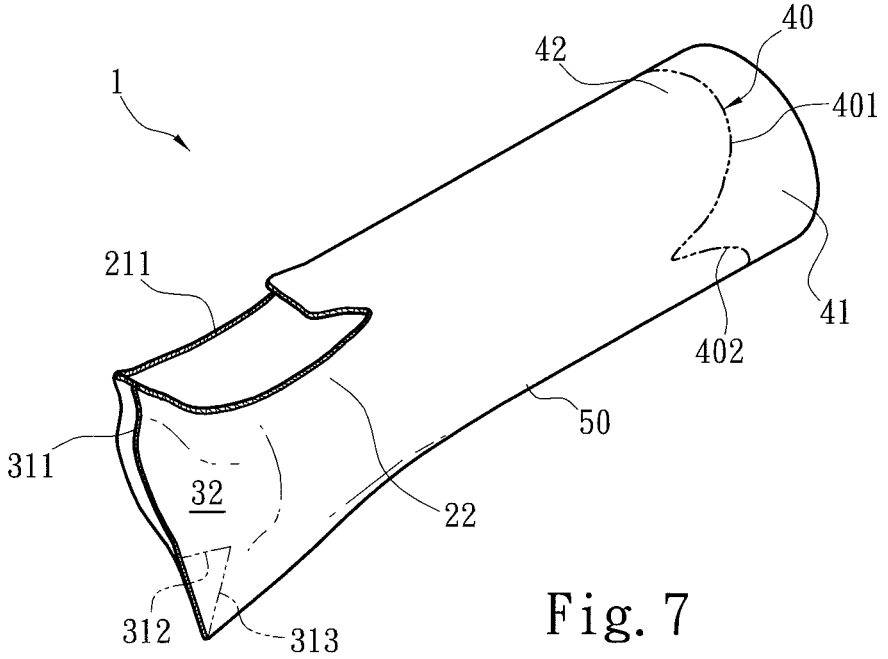
FIG. 7 is an isometric appearance schematic diagram of the tubular fabric in FIG. 6 of the present invention having been continually trimmed and overlocked.
Figure 8:
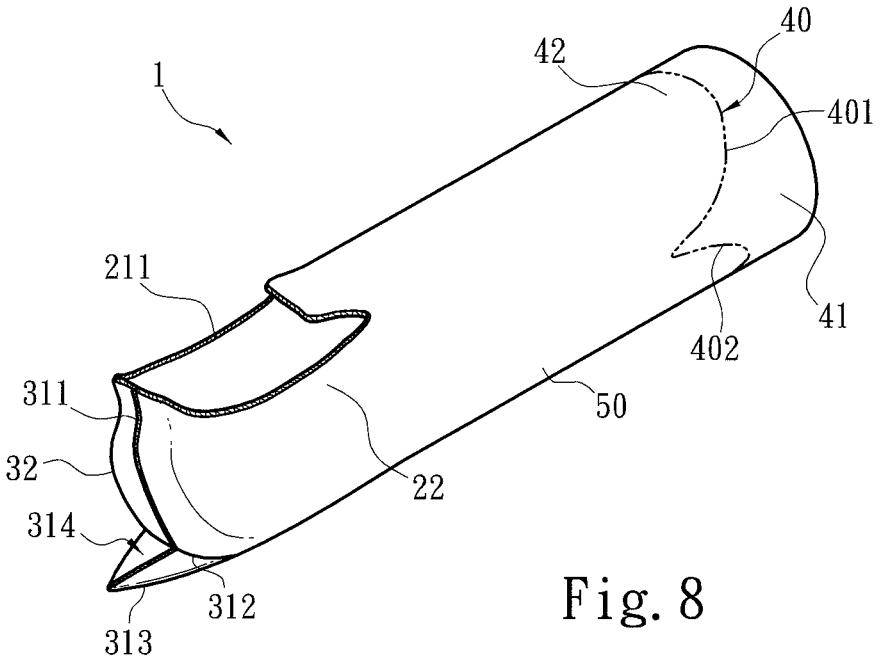
FIG. 8 is an isometric appearance schematic diagram of the tubular fabric in FIG. 7 of the present invention having been continually trimmed and overlocked.
Figure 9:
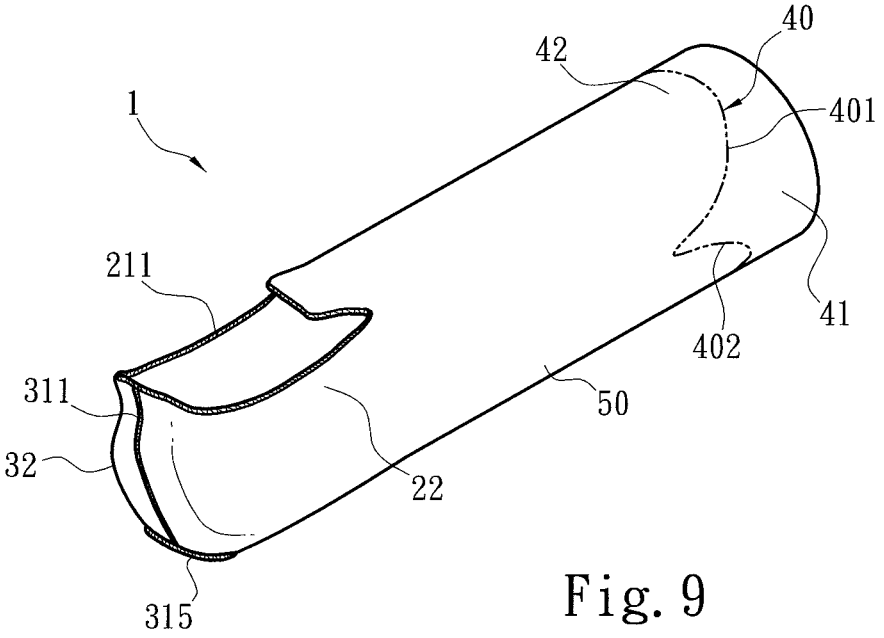
FIG. 9 is an isometric appearance schematic diagram of the tubular fabric in FIG. 8 of the present invention having been continually trimmed and overlocked.
Figure 10:
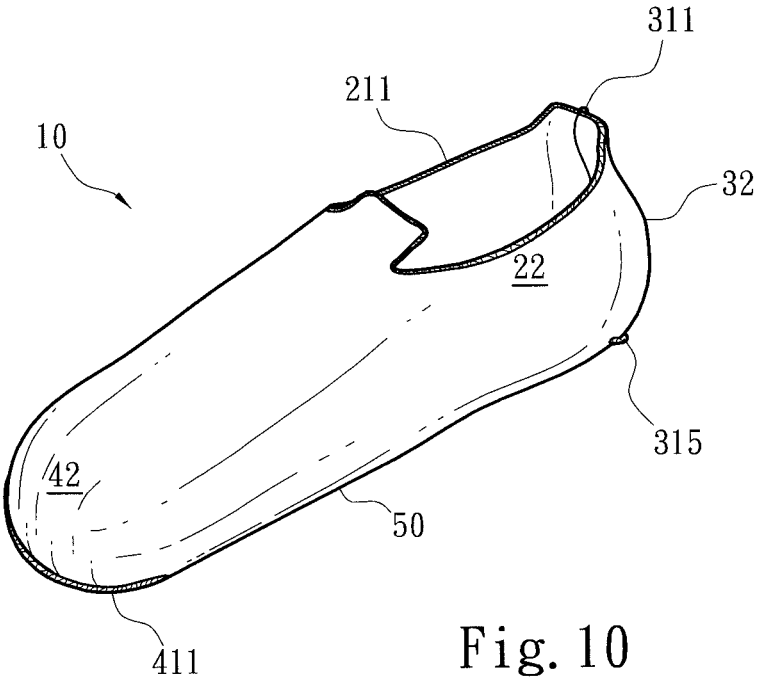
FIG. 10 is an isometric appearance schematic diagram a shoe embryo manufactured from the tubular fabric in FIG. 9 of the present invention having been continually trimmed and overlocked.
Figure 11:
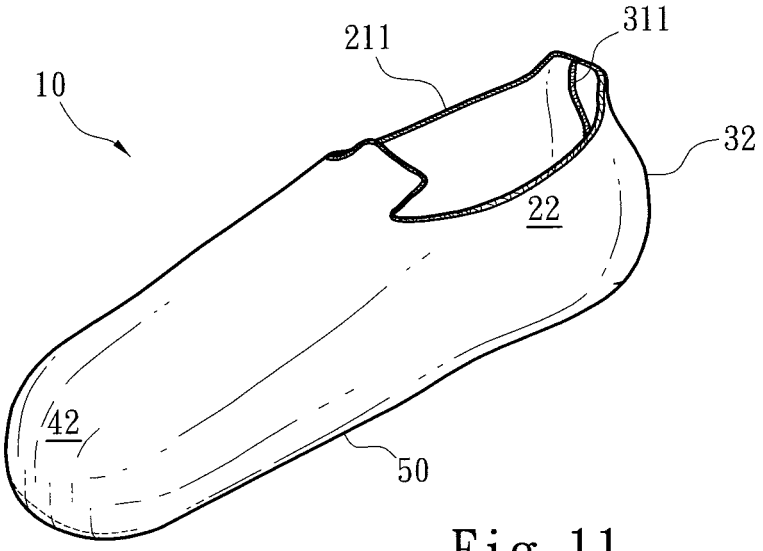
FIG. 11 is an isometric appearance schematic diagram of the shoe embryo in FIG. 10 of the present invention that has been turned inside out.
Figure 12:
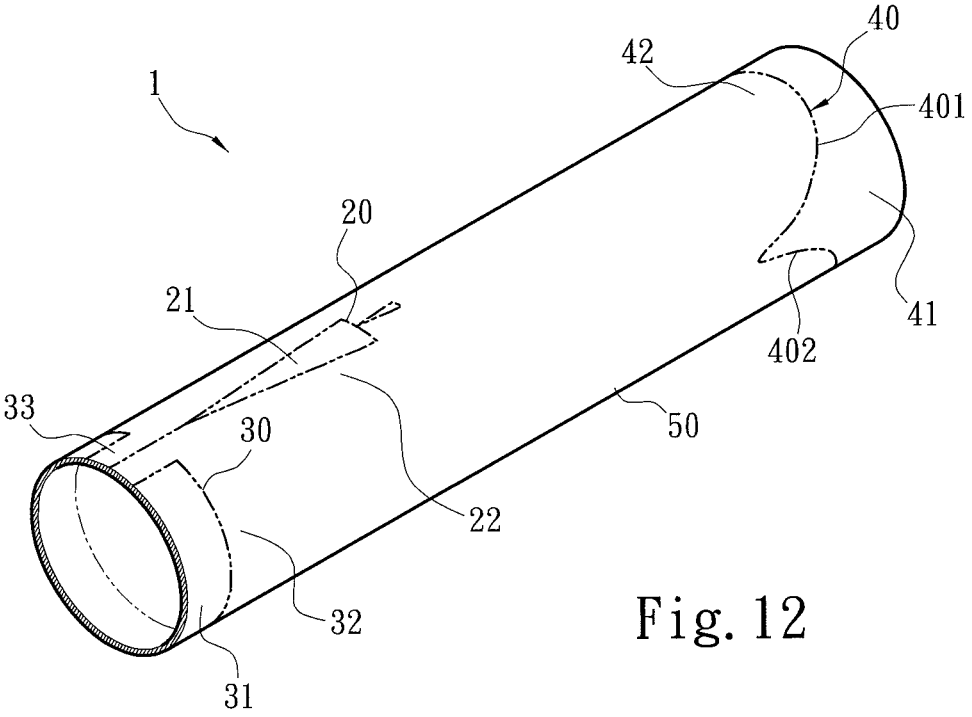
FIG. 12 is an isometric appearance schematic diagram of a tubular fabric according to a second embodiment of the present invention.
Figure 13:
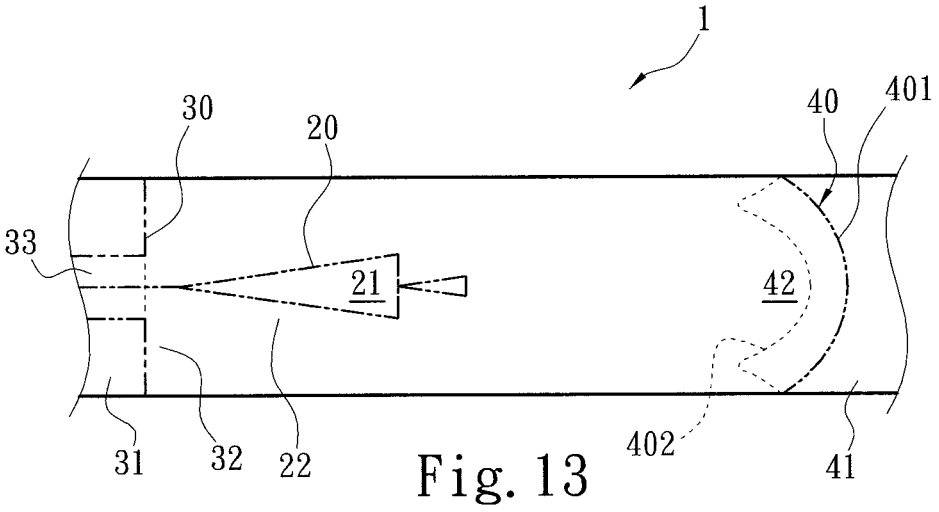
FIG. 13 is a top planar view of FIG. 12 of the present invention.
Figure 14:
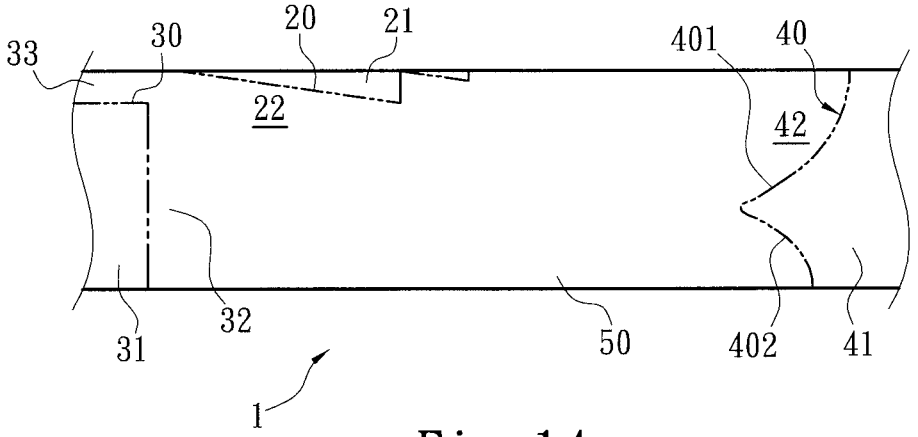
FIG. 14 is a side planar view of FIG. 12 of the present invention.
Figure 15:
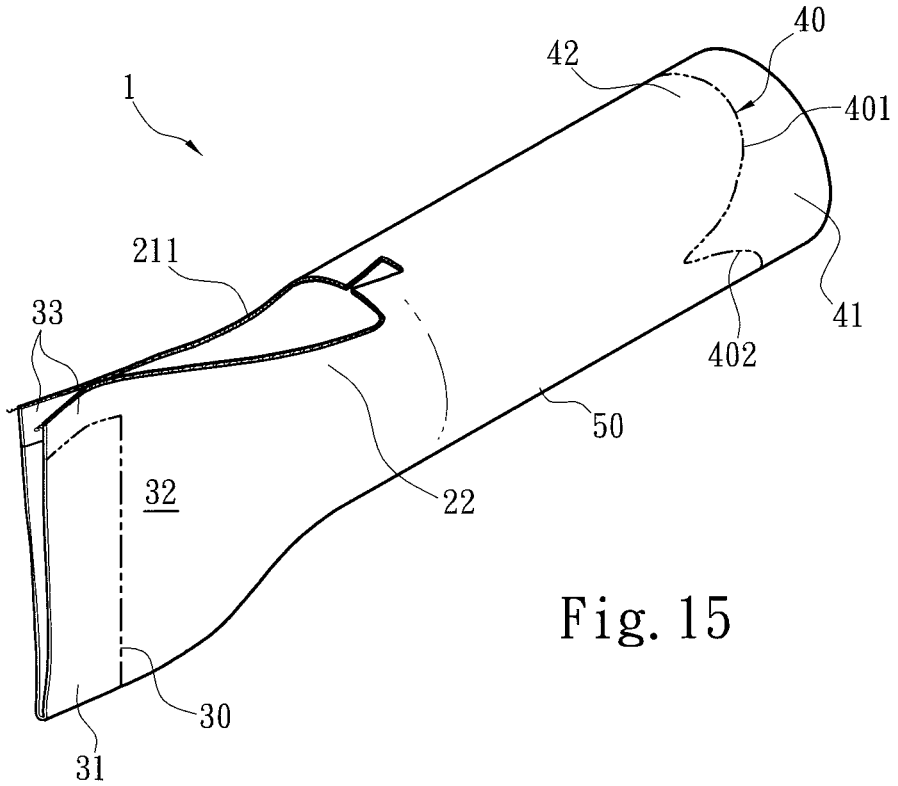
FIG. 15 is an isometric appearance schematic diagram of the tubular fabric in FIG. 12 of the present invention having been trimmed and overlocked.

FIG. 1 to FIG. 11 show schematic diagrams of a first embodiment. In this embodiment, a tubular fabric 1 is woven from at least two yarns. As seen from FIG. 1 to FIG. 5, the tubular fabric 1 has its one end woven with a toe portion tailor auxiliary line 40 and the other end woven with a heel portion tailor auxiliary line 30. An ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into a toe portion trimmed region 41, an ankle portion trimmed region 21 and a heel portion trimmed region 31 by the toe portion tailor auxiliary line 40, the ankle portion tailor auxiliary line 20 and the heel portion tailor auxiliary line 30, respectively. First of all, the ankle portion trimmed region 21 is trimmed and removed, and an overlock process is performed according to the ankle portion tailor auxiliary line 20 to form an ankle opening overlock line 211 at the tubular fabric 1, as shown in FIG. 6. The heel portion trimmed region 31 is trimmed and removed, and an overlock process is performed according to the heel portion tailor auxiliary line 30 to form a heel overlock line 311 at the tubular fabric 1, as shown in FIG. 7. Next, a part below the heel overlock line 311 is folded to form a concave crease 312 and a revealed crease 313, such that a sole trimmed region 314 is defined at the tubular fabric 1 by the concave crease 312 and the revealed crease 313, as shown in FIG. 8. Next, the sole trimmed region 314 is trimmed and removed, and an overlock process is performed according to the concave crease 312 to form a sole overlock line 315 at the tubular fabric 1, as shown in FIG. 9. The toe portion trimmed region 41 is then trimmed and removed, and the toe portion tailor auxiliary line 40 is combined in an overlapping manner for an overlock process to form a toe cap overlock line 411. Further, the tubular fabric 1 is shaped into a shoe embryo 10 including an ankle portion 22, a heel portion 32, a toe cap portion 42 and a sole portion 50, as shown in FIG. 10. The shoe embryo 10 may then be used for subsequent shoe manufacturing processes. Alternatively, in FIG. 11, the shoe embryo 10 may be entirely turned inside out for subsequent shoe manufacturing processes. It should be noted that, concerning the sequences for forming the overlock lines by the trimming and overlock processes, the toe cap overlock line 411, the ankle opening overlock line 211, the heel overlock line 311 and the sole overlock line 315 may be sequentially formed by the respective trimming and overlock processes. Further, the tubular fabric 1 is woven from at least two differently-colored yarns, and the ankle portion tailor auxiliary line 20, the heel portion tailor auxiliary line 30 and the toe portion tailor auxiliary line 40 may be selected and woven from one of the yarns used for weaving the tubular fabric 1. Further, the ankle portion tailor auxiliary line 20, the heel portion tailor auxiliary line 30 and the toe portion tailor auxiliary line 40 may be selected and woven from one of the colors of the yarns used for weaving the tubular fabric 1. That is to say, the ankle portion tailor auxiliary line 20, the heel portion tailor auxiliary line 30 and the toe portion tailor auxiliary line 40 may be woven from one of the yarns or one of the colors of the yarns used for weaving the tubular fabric 1. It should be noted that, the toe portion tailor auxiliary line 40 includes an arched above-toe auxiliary segment 401, and an arched below-toe auxiliary segment 402 connected to two ends of the above-toe auxiliary segment 401. The length of the above-toe auxiliary segment 401 is greater than the length of the below-toe auxiliary segment 402, which is beneficial for the toe cap overlock line 411 to form within the range of the sole portion 50. Thus, when later incorporated with a sole material (a generally known shoe manufacturing process, not shown in the drawing), the toe cap overlock line 411 may be easily concealed and adorned.

Again referring to FIG. 1, FIG. 10 and FIG. 11, the shoe embryo 10 in the drawings according to the first embodiment is tailored and manufactured from a tubular fabric 1, which is woven from at least two yarns. The tubular fabric 1 has its one end woven with the toe portion tailor auxiliary line 40 and its other end woven with the heel portion tailor auxiliary line 30, and the ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into the toe portion trimmed region 41, the ankle portion trimmed region 21 and the heel portion trimmed region 31 by the toe portion tailor auxiliary line 40, the ankle portion tailor auxiliary line 20 and the heel portion tailor auxiliary line 30, respectively. The shoe embryo 10 includes the sole portion 50, the toe cap portion 42 located at one end of the sole portion 50, the heel portion 32 located at the other end of the sole portion 50, and the ankle portion 22 located above the sole portion 50 and near the heel portion 32. The ankle portion 22 includes the ankle opening overlock line 211 formed by trimming the ankle portion trimmed region 21 of the tubular fabric 1 and overlocking. The heel portion 32 includes the heel overlock line 311 formed by trimming the heel portion trimmed region 31 of the tubular fabric 1 and overlocking, and the sole overlock line 315 formed by folding below the heel overlock line 311 and overlocking. The toe cap portion 42 includes the toe cap overlock line 411 formed by trimming the toe portion trimmed region 41 of the tubular fabric 1 and overlocking. Thus, the shoe embryo 10 may be used for shoe manufacturing processes.

Figure 16:
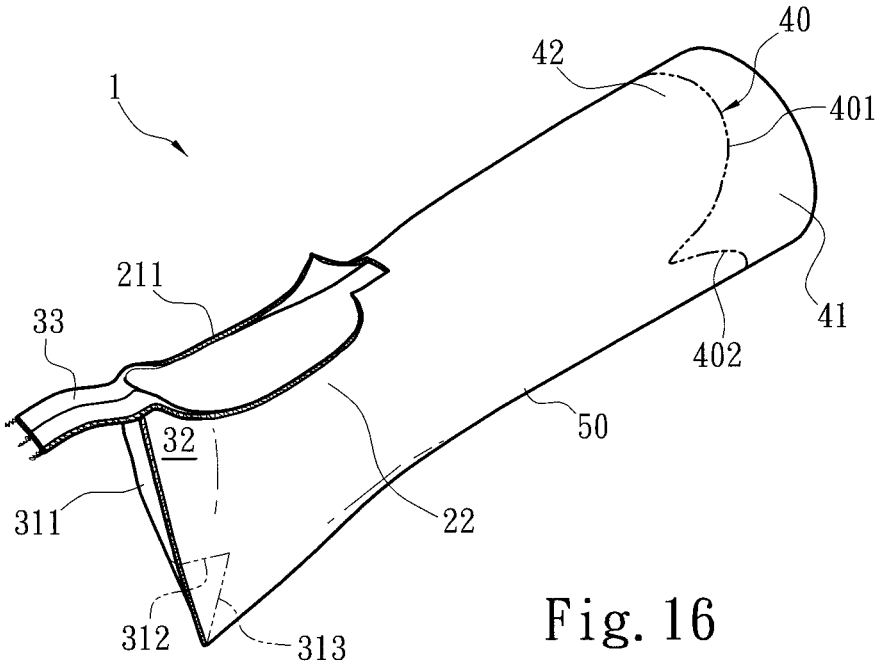
FIG. 16 is an isometric appearance schematic diagram of the tubular fabric in FIG. 15 of the present invention having been continually trimmed and overlocked.
Figure 17:
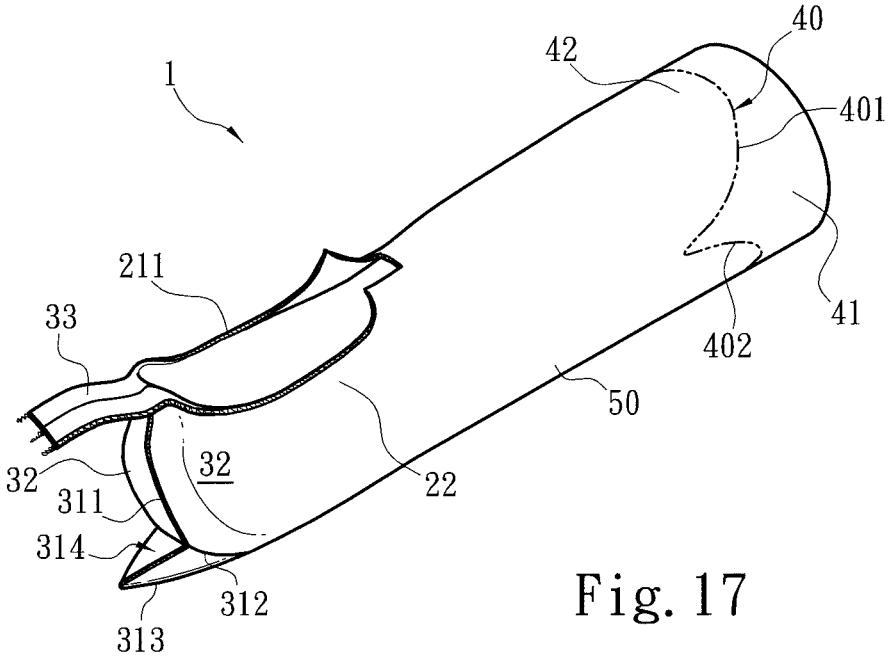
FIG. 17 is an isometric appearance schematic diagram of the tubular fabric in FIG. 16 of the present invention having been continually trimmed and overlocked.
Figure 18:
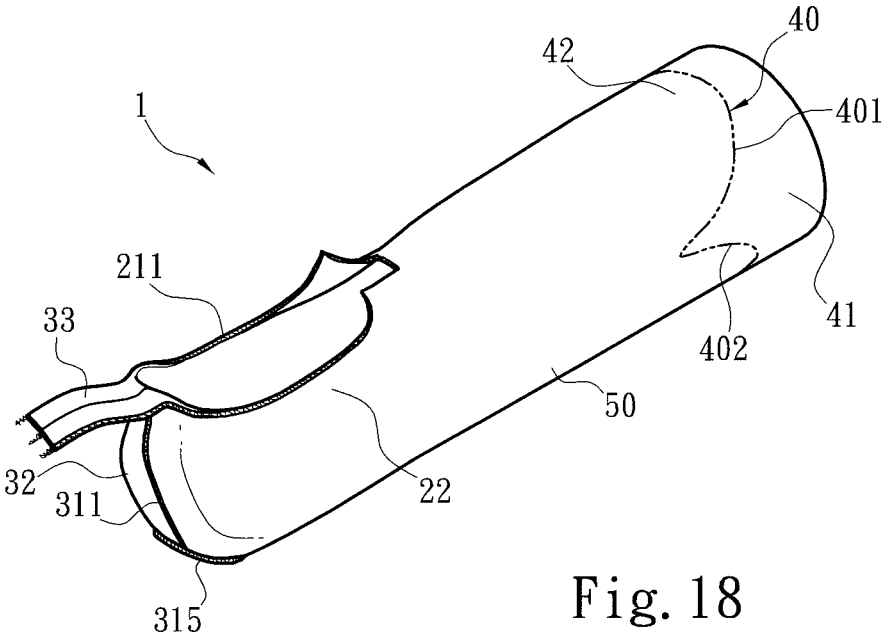
FIG. 18 is an isometric appearance schematic diagram of the tubular fabric in FIG. 17 of the present invention having been continually trimmed and overlocked.
Figure 19:
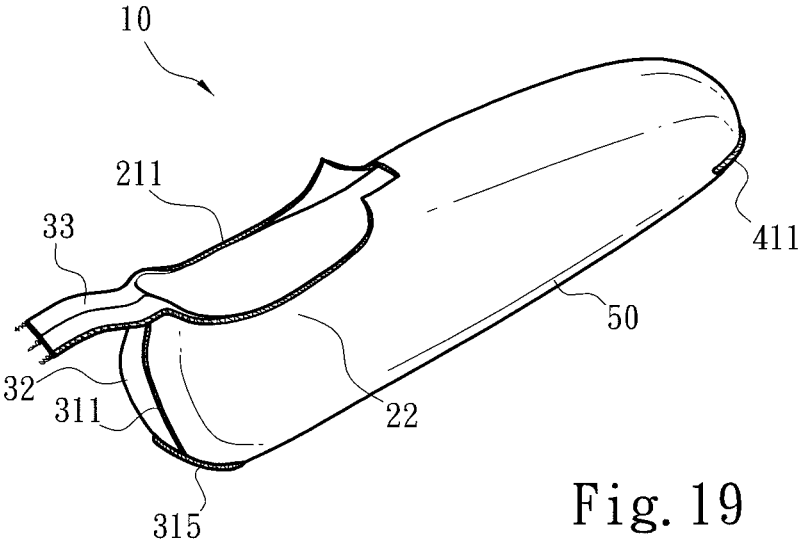
FIG. 19 is an isometric appearance schematic diagram a shoe embryo manufactured from the tubular fabric in FIG. 9 of the present invention having been continually trimmed and overlocked.
Figure 20:
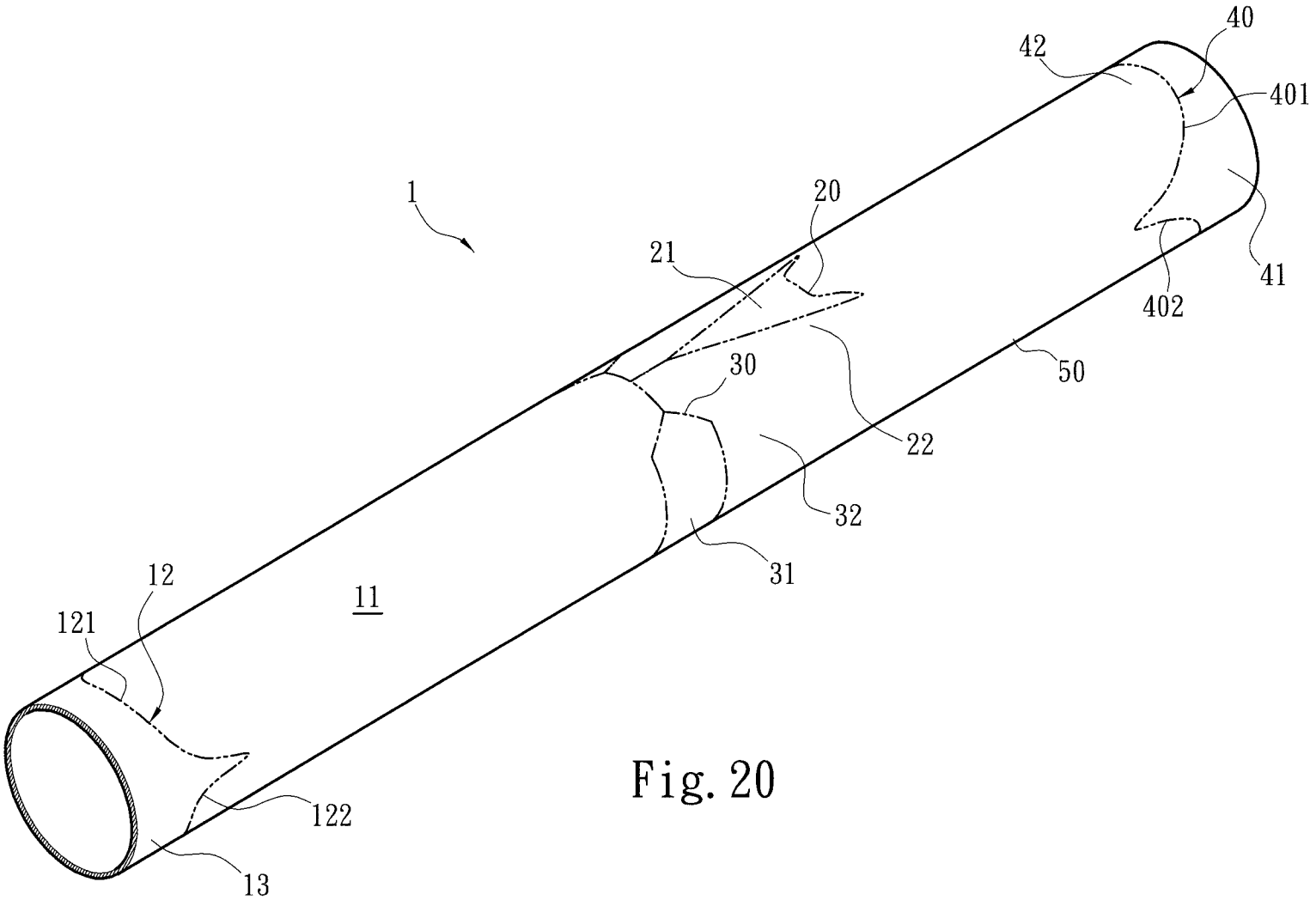
FIG. 20 is an isometric appearance schematic diagram of a tubular fabric according to a third embodiment of the present invention.
Figure 21:
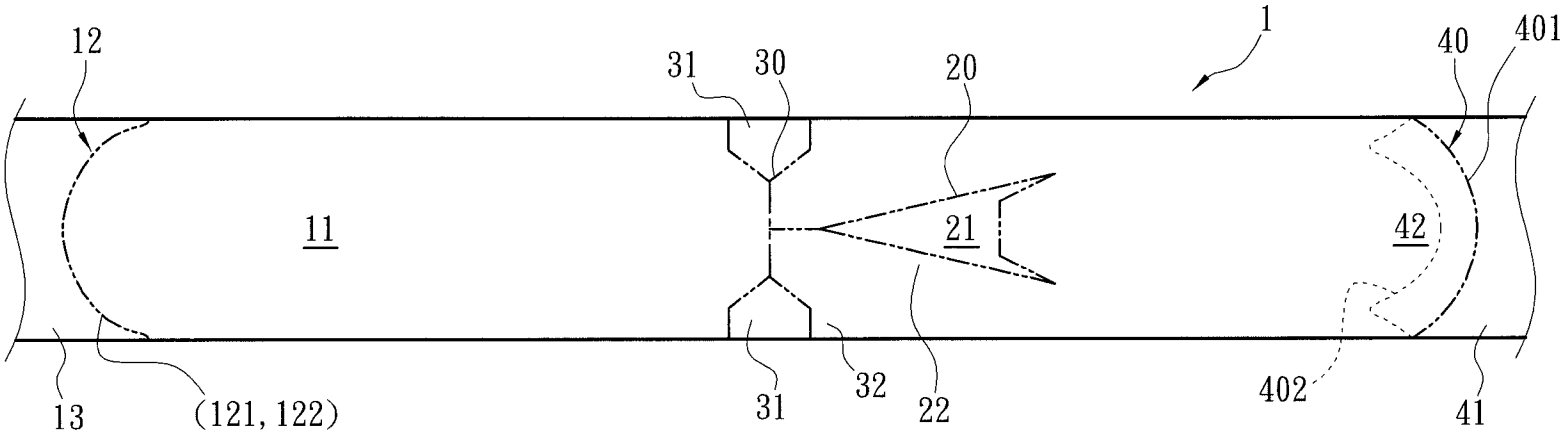
FIG. 21 is a top planar view of FIG. 20 of the present invention.
Figure 22:
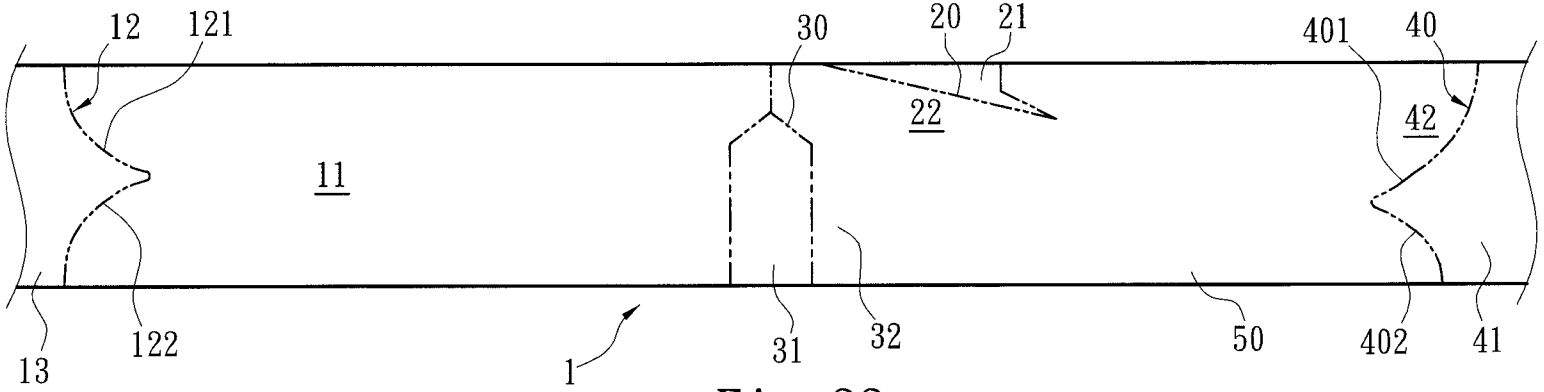
FIG. 22 is a side planar view of FIG. 20 of the present invention.

FIG. 12 to FIG. 19 show schematic diagrams of a second embodiment of the present invention. In this embodiment, the tubular fabric 1 is woven from at least two yarns. As seen from FIG. 12 to FIG. 14, the tubular fabric 1 has its one end woven with a toe portion tailor auxiliary line 40 and the other end woven with the heel portion tailor auxiliary line 30. The ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into the toe portion trimmed region 41, the ankle portion trimmed region 21 and the heel portion trimmed region 31 by the toe portion tailor auxiliary line 40, the ankle portion tailor auxiliary line 20 and the heel portion tailor auxiliary line 30, respectively. It is clearly seen that the path design of the ankle portion tailor auxiliary line 20 of the second embodiment is different from the path design of the ankle portion tailor auxiliary line 20 of the first embodiment (also referring to FIG. 1 to FIG. 5). Thus, to satisfy market demands, the ankle portion trimmed region 21 defined in the second embodiment and the first embodiment may generate different shapes and variations. First of all, the ankle portion trimmed region 21 is trimmed and removed, and an overlock process is performed according to the ankle portion tailor auxiliary line 20 to form the ankle opening overlock line 211 at the tubular fabric 1, as shown in 15. The heel portion trimmed region 31 is trimmed and removed, and an overlock process is performed according to the heel portion tailor auxiliary line 30 to form the heel overlock line 311 at the tubular fabric 1. Because the path design of the heel portion tailor auxiliary line 30 does not connect to the path of the ankle portion tailor auxiliary line 20, after the ankle opening overlock line 211 and the heel overlock line 311 are formed by sequentially trimming and overlock processes, a joint of the ankle portion 22 and the heel portion 32 may be extended to form a shoe upper 33, as shown in FIG. 16. A part below the heel overlock line 311 is folded to form the concave crease 312 and the revealed crease 313, such that the sole trimmed region 314 is defined at the tubular fabric 1 by the concave crease 312 and the revealed crease 313, as shown in FIG. 17. Next, the sole trimmed region 314 is trimmed and removed, and an overlock process is performed according to the concave crease 312 to form the sole overlock line 315 at the tubular fabric 1, as shown in FIG. 18. The toe portion trimmed region 41 is then trimmed and removed, the toe portion tailor auxiliary line 40 is combined in an overlapping manner for an overlock process to form the toe cap overlock line 411. Further, the tubular fabric 1 is shaped into the shoe embryo 10 including the ankle portion 22, the heel portion 32, the toe cap portion 42 and the sole portion 50, as shown in FIG. 19. The shoe embryo 10 may then be used for subsequent shoe manufacturing processes. It should be noted that, concerning the sequences for forming the overlock lines by the trimming and overlock processes, the toe cap overlock line 411, the ankle opening overlock line 211, the heel overlock line 311 and the sole overlock line 315 may be sequentially formed by the respective trimming and overlock processes. Further, the tubular fabric 1 is woven from at least two differently-colored yarns, and the ankle portion tailor auxiliary line 20, the heel portion tailor auxiliary line 30 and the toe portion tailor auxiliary line 40 may be selected and woven from one of the yarns used for weaving the tubular fabric 1. Further, the ankle portion tailor auxiliary line 20, the heel portion tailor auxiliary line 30 and the toe portion tailor auxiliary line 40 may be selected and woven from one of the colors of the yarns used for weaving the tubular fabric 1. That is to say, the ankle portion tailor auxiliary line 20, the heel portion tailor auxiliary line 30 and the toe portion tailor auxiliary line 40 may be woven from one of the yarns or one of the colors of the yarns used for weaving the tubular fabric 1. It should be noted that, the toe portion tailor auxiliary line 40 includes the arched above-toe auxiliary segment 401, and the arched below-toe auxiliary segment 402 connected to the two ends of the above-toe auxiliary segment 401. The length of the above-toe auxiliary segment 401 is greater than the length of the below-toe auxiliary segment 402, which is beneficial for the toe cap overlock line 411 to form within the range of the sole portion 50. Thus, when later incorporated with a sole material (a generally known shoe manufacturing process, not shown in the drawing), the toe cap overlock line 411 may be easily concealed and adorned.

Again referring to FIG. 12 and FIG. 19, the shoe embryo 10 in the drawings according to the second embodiment is tailored and manufactured from the tubular fabric 1, which is woven from at least two yarns. The tubular fabric 1 has its one end woven with the toe portion tailor auxiliary line 40 and its other end woven with the heel portion tailor auxiliary line 30, and the ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into the toe portion trimmed region 41, the ankle portion trimmed region 21 and the heel portion trimmed region 31 by the toe portion tailor auxiliary line 40, the ankle portion tailor auxiliary line 20 and the heel portion tailor auxiliary line 30, respectively. The shoe embryo 10 includes the sole portion 50, the toe cap portion 42 located at one end of the sole portion 50, the heel portion 32 located at the other end of the sole portion 50, and the ankle portion 22 located above the sole portion 50 and near the heel portion 32. The ankle portion 22 includes the ankle opening overlock line 211 formed by trimming the ankle portion trimmed region 21 of the tubular fabric 1 and overlocking. The heel portion 32 includes the heel overlock line 311 formed by trimming the heel portion trimmed region 31 of the tubular fabric 1 and overlocking, and the sole overlock line 315 formed by folding below the heel overlock line 311 and overlocking. The toe cap portion 42 includes the toe cap overlock line 411 formed by trimming the toe portion trimmed region 41 of the tubular fabric 1 and overlocking. The joint of the ankle portion 22 and the heel portion 32 is extended to form the shoe upper 33. Thus, the shoe embryo 10 may be used for shoe manufacturing processes.

Figure 23:
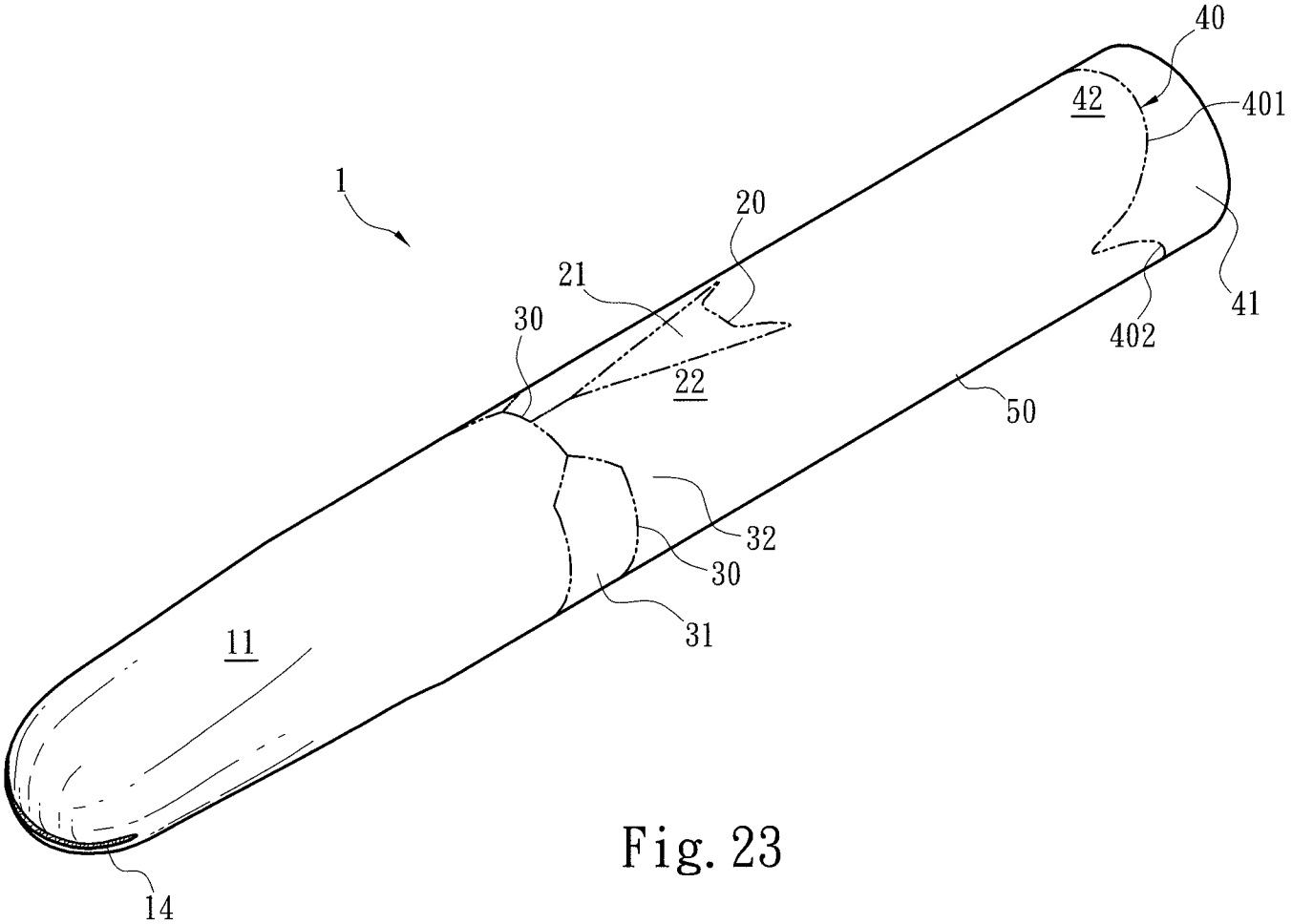
FIG. 23 is an isometric appearance schematic diagram of the tubular fabric in FIG. 20 of the present invention with its one end trimmed and overlocked.
Figure 24:
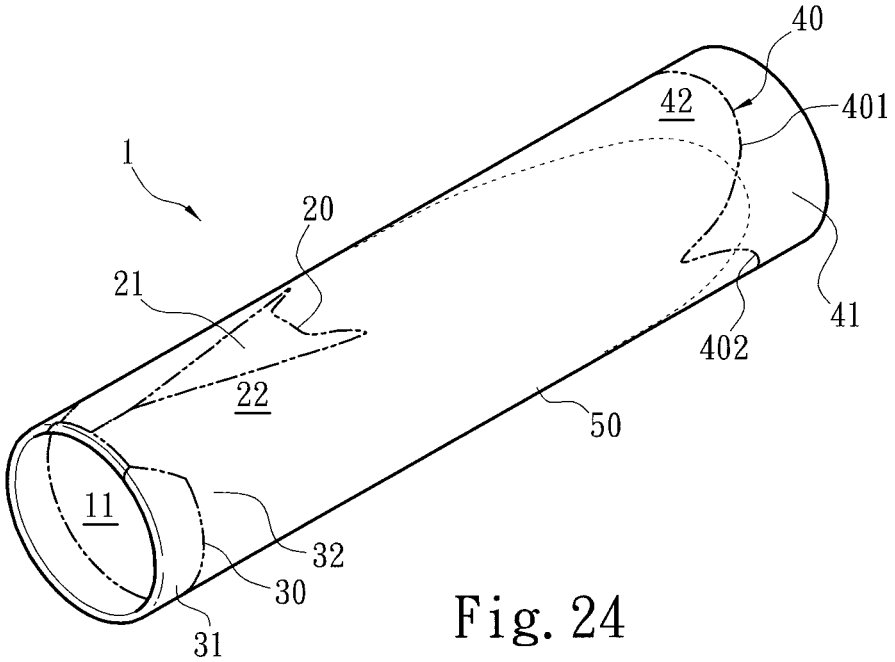
FIG. 24 is an isometric appearance schematic diagram of the tubular fabric in FIG. 23 of the present invention with its one end overlapped and placed into the other end.
Figure 25:
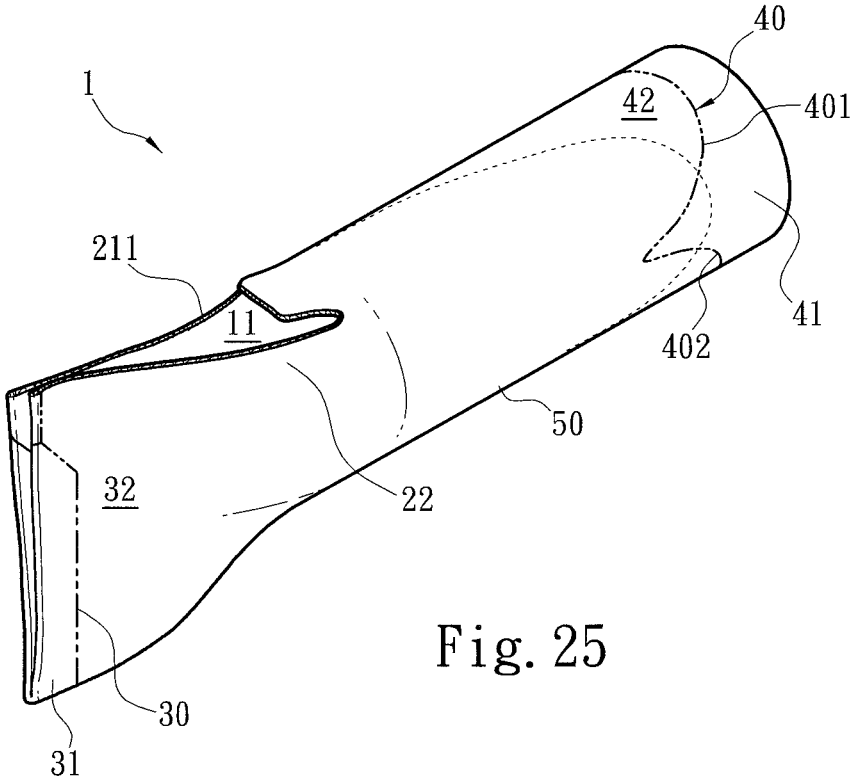
FIG. 25 is an isometric appearance schematic diagram of the tubular fabric in FIG. 24 of the present invention having been continually trimmed and overlocked.
Figure 26:
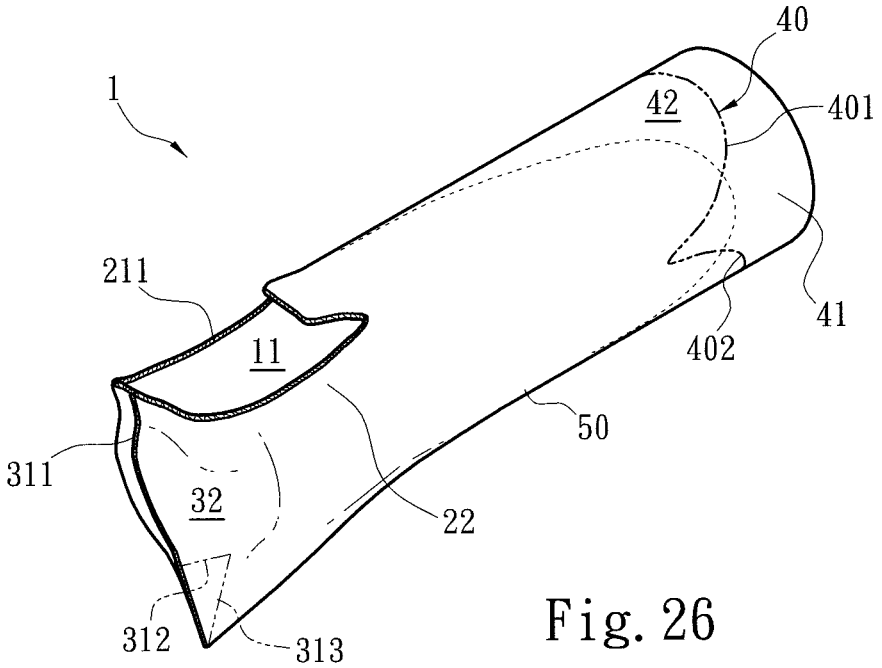
FIG. 26 is an isometric appearance schematic diagram of the tubular fabric in FIG. 25 of the present invention having been continually trimmed and overlocked.
Figure 27:
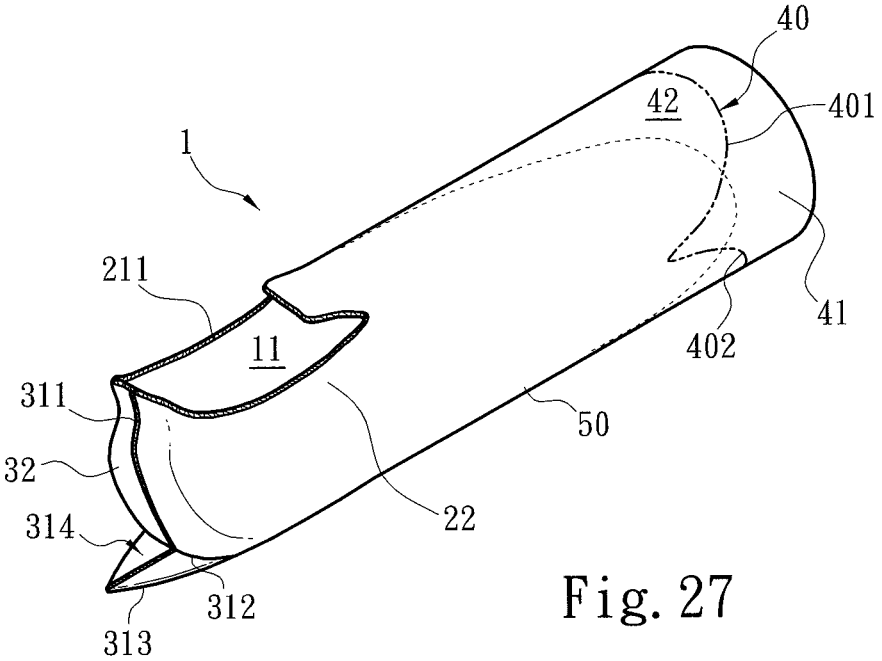
FIG. 27 is an isometric appearance schematic diagram of the tubular fabric in FIG. 26 of the present invention having been continually trimmed and overlocked.
Figure 28:
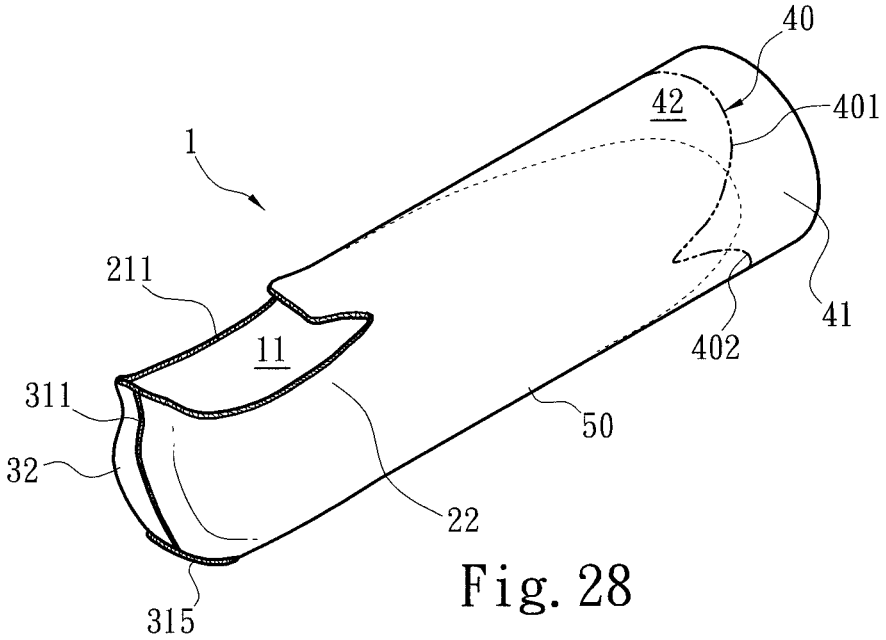
FIG. 28 is an isometric appearance schematic diagram of the tubular fabric in FIG. 27 of the present invention having been continually trimmed and overlocked.
Figure 29:
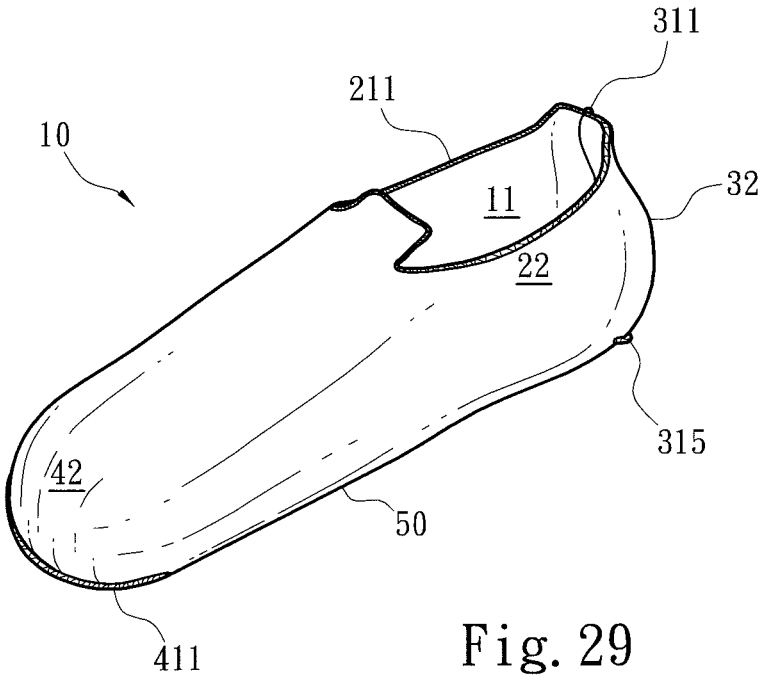
FIG. 29 is an isometric appearance schematic diagram a shoe embryo manufactured from the tubular fabric in FIG. 28 of the present invention having been continually trimmed and overlocked.

FIG. 20 to FIG. 29 show schematic diagrams of a third embodiment of the present invention. In this embodiment, the tubular fabric 1 is woven from at least two yarns. As seen from FIG. 20 to FIG. 22, the tubular fabric 1 has its one end woven with a toe portion tailor auxiliary line 40, and the other end woven with a lining sealing auxiliary line 12. The heel portion tailor auxiliary line 30 is woven at a center between the toe portion tailor auxiliary line 40 and the lining sealing auxiliary line 12, such that a lining fabric 11 is defined between the heel portion tailor auxiliary line 30 and the lining sealing auxiliary line 12. The ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into the toe portion trimmed region 41, the ankle portion trimmed region 21, the heel portion trimmed region 31 and a lining trimmed region 13 by the toe portion tailor auxiliary line 40, the ankle portion tailor auxiliary line 20, the heel portion tailor auxiliary line 30 and the lining sealing auxiliary line 12, respectively. First of all, the lining trimmed region 13 is trimmed and removed, and the lining sealing auxiliary line 12 is combined in an overlapping manner for an overlock process to form a lining overlock line 14 at the tubular fabric 1, as shown in FIG. 23. Using the heel portion tailor auxiliary line 30 as a basis (i.e., when the heel portion tailor auxiliary line 30 is woven, a segment serving as a basis may be woven at an appropriate position of the heel portion tailor auxiliary line 30), the lining fabric 11 is folded in reverse into the tubular fabric 1, as shown in FIG. 24. The ankle portion trimmed region 21 and a part of the lining fabric 11 corresponding to the ankle portion trimmed region 21 are together trimmed and removed, and an overlock process is performed jointly with the lining fabric 11 according to the ankle portion tailor auxiliary line 20 to form the ankle opening overlock line 211 at the tubular fabric 1, as shown in FIG. 25. The heel portion trimmed region 31 and a part of the lining fabric 11 corresponding to the heel portion trimmed region 31 are together trimmed and removed, and an overlock process is performed jointly with the lining fabric 11 according to the heel portion tailor auxiliary line 30 to form the heel overlock line 311 at the tubular fabric 1, as shown in FIG. 26. A part below the heel overlock line 311 is folded to form the concave crease 312 and the revealed crease 313, such that the sole trimmed region 314 is defined at the tubular fabric 1 by the concave crease 312 and the revealed crease 313, as shown in FIG. 27. Next, the sole trimmed region 314 is trimmed and removed, and an overlock process is performed according to the concave crease 312 to form the sole overlock line 315 at the tubular fabric 1, as shown in FIG. 28. The toe portion trimmed region 41 is then trimmed and removed, and the toe portion tailor auxiliary line 40 is combined in an overlapping manner for an overlock process to form the toe cap overlock line 411. Further, the tubular fabric 1 is shaped into the shoe embryo 10 including the ankle portion 22, the heel portion 32, the toe cap portion 42 and the sole portion 50 as well as the lining fabric 11 therein, as shown in FIG. 29. The shoe embryo 10 may then be used for subsequent shoe manufacturing processes. It should be noted that, after the lining fabric 11 is folded in reverse and placed into the tubular fabric 1, concerning the sequences for forming the overlock lines by the trimming and overlock processes, the toe cap overlock line 411, the ankle opening overlock line 211, the heel overlock line 311 and the sole overlock line 315 may be sequentially formed by the respective trimming and overlock processes. Further, the tubular fabric 1 is woven from at least two differently-colored yarns, and the lining sealing auxiliary line 12, the ankle portion tailor auxiliary line 20, the heel portion tailor auxiliary line 30 and the toe portion tailor auxiliary line 40 may be selected and woven from one of the yarns used for weaving the tubular fabric 1. Further, the lining sealing auxiliary line 12, the ankle portion tailor auxiliary line 20, the heel portion tailor auxiliary line 30 and the toe portion tailor auxiliary line 40 may be selected and woven from one of the colors of the yarns used for weaving the tubular fabric 1. That is to say, the lining sealing auxiliary line 12, the ankle portion tailor auxiliary line 20, the heel portion tailor auxiliary line 30 and the toe portion tailor auxiliary line 40 may be may be woven from one of the yarns or one of the colors of the yarns used for weaving the tubular fabric 1. It should be noted that, the toe portion tailor auxiliary line 40 includes the arched above-toe auxiliary segment 401, and the arched below-toe auxiliary segment 402 connected to the two ends of the above-toe auxiliary segment 401. The length of the above-toe auxiliary segment 401 is greater than the length of the below-toe auxiliary segment 402, which is beneficial for the toe cap overlock line 411 to form within the range of the sole portion 50. Thus, when later incorporated with a sole material (a generally known shoe manufacturing process, not shown in the drawing), the toe cap overlock line 411 may be easily concealed and adorned. Further, the lining sealing auxiliary line 12 includes an arched upper auxiliary segment 121, and an arched lower auxiliary segment 122 connected to two ends of the upper auxiliary segment 121. The length of the upper auxiliary segment 121 is greater than or equal to the length of the lower auxiliary segment 122. That is to say, when length of the upper auxiliary segment 121 is equal to the length of the lower auxiliary segment 122, the upper auxiliary segment 121 is allowed to more easily combine with the lower auxiliary segment 122 in an overlapping manner for an overlock process to form the lining overlock line 14 (as shown in FIG. 23). Since the lining overlock line 14 is placed into the tubular fabric 1, the position of the lining overlock line 14 does not affect the appearance of the shoe embryo 10 formed from the tubular fabric 1. Alternatively, the length of the upper auxiliary segment 121 may also be greater than the length of the lower auxiliary segment 122, such that the lining overlock line 14 may be formed on the sole portion 50 inside the shoe embryo 10. It should be noted that, when the heel overlock line 311 of the third embodiment of the present invention is sewn according to the path of the second embodiment, the joint of the ankle portion 22 and the heel portion 32 of the third embodiment may also be extended to form the shoe upper 33, as shown in FIG. 16 to FIG. 19 of the second embodiment.

Again referring to FIG. 20 and FIG. 29, the shoe embryo 10 according to the third embodiment is tailored and manufactured from the tubular fabric 1, which is woven from at least two yarns. The tubular fabric 1 has its one end woven with the toe portion tailor auxiliary line 40, and its other end woven with the lining sealing auxiliary line 12. The heel portion tailor auxiliary line 30 is woven at the center of the toe portion tailor auxiliary line 40 and the lining sealing auxiliary line 12, and the lining fabric 11 is defined between the heel portion tailor auxiliary line 30 and the lining sealing auxiliary line 12. The ankle portion tailor auxiliary line 20 is woven at a position between the heel portion tailor auxiliary line 30 and the toe portion tailor auxiliary line 40 and near the heel portion tailor auxiliary line 30. The tubular fabric 1 is sequentially defined into the toe portion trimmed region 41, the ankle portion trimmed region 21, the heel portion trimmed region 31 and the lining trimmed region 13 by the toe portion tailor auxiliary line 40, the ankle portion tailor auxiliary line 20, the heel portion tailor auxiliary line 30 and the lining sealing auxiliary line 12, respectively. The shoe embryo 10 internally includes the lining fabric 11, whose front end is trimmed as the lining trimmed region 13 and is combined in an overlapping manner and overlocked. The shoe embryo 10 further includes the sole portion 50, the toe cap portion 42 located at one end of the sole portion 50, the heel portion 32 located at the other end of the sole portion 50, and the ankle portion 22 located above the sole portion 50 and near the heel portion 32. The ankle portion 22 includes the ankle opening overlock line 211 formed by together trimming the ankle portion trimmed region 21 of the tubular fabric 1 and the lining fabric 11 and overlocking. The heel portion 32 includes the heel overlock line 311 formed by together trimming the heel portion trimmed region 31 of the tubular fabric 1 and the lining fabric 11 and overlocking, and the sole overlock line 315 formed by folding below the heel overlock line 311 and overlocking. The toe cap portion 42 includes the toe cap overlock line 411 formed by trimming the toe portion trimmed region 41 of the tubular fabric 1 and overlocking. Thus, the shoe embryo 10 may be used for shoe manufacturing processes.

What is claimed is:

1. A shoe embryo tailored and manufactured from a tubular fabric, wherein the shoe embryo is tailored from the tubular fabric, and comprises:

a sole portion;

a toe cap portion located at one end of the sole portion;

a heel portion located at one other end of the sole portion; and an ankle portion located above the sole portion and near the heel portion;

wherein the tubular fabric is a unitary and fully integrated one piece of fabric in tubular shape, and wherein the sole portion, the toe cap portion, the heel portion, and the ankle portion of the shoe embryo are integrated portions of the tubular fabric, and wherein the ankle portion comprises an ankle opening overlock line formed by trimming and overlocking the tubular fabric; the heel portion comprises a heel overlock line formed by trimming and overlocking the tubular fabric, and a sole overlock line formed by folding below the heel overlock line first and then trimming and overlocking the tubular fabric; and the toe cap portion comprises a toe cap overlock line formed by trimming and overlocking the tubular fabric; wherein the toe cap overlock line and the sole overlock line do not connect with each other.

2. The shoe embryo tailored and manufactured from a tubular fabric of claim 1, wherein a joint of the ankle portion and the heel portion is extended to form a shoe upper.

* * * * *